United States Patent [19]

Horne et al.

[11] Patent Number: 4,793,223

[45] Date of Patent: Dec. 27, 1988

[54] NUT AND WRENCH SYSTEM

[75] Inventors: John M. Horne, Grove City; Daniel L. Umbaugh, Slippery Rock, both of Pa.

[73] Assignee: Cooper Industries, Inc., Houston, Tex.

[21] Appl. No.: 935,874

[22] Filed: Nov. 28, 1986

[51] Int. Cl.[4] ..... B25B 13/50; B25B 13/58

[52] U.S. Cl. ..... 81/176.15

[58] Field of Search ..... 81/54, 57, 57.24, 57.4, 81/176.1, 176.15, 176.2

[56] References Cited

U.S. PATENT DOCUMENTS

| | | | |
|---|---|---|---|
| 1,542,291 | 6/1925 | Economides | 81/176.1 |
| 2,386,254 | 10/1945 | Meyer | 81/176.15 |
| 2,465,695 | 3/1949 | Osborne | 81/61 |
| 3,472,083 | 10/1969 | Schnepel | 81/57 |
| 3,498,159 | 3/1970 | Wilmeth | 81/57 |

FOREIGN PATENT DOCUMENTS

| | | | |
|---|---|---|---|
| 352303 | 4/1961 | Switzerland | 81/54 |
| 747709 | 7/1980 | U.S.S.R. | 81/57.24 |
| 812556 | 3/1981 | U.S.S.R. | 81/54 |

*Primary Examiner*—Frederick R. Schmidt
*Assistant Examiner*—William E. Terrell
*Attorney, Agent, or Firm*—Eddie E. Scott; Alan R. Thiele; Nelson A. Blish

[57] ABSTRACT

A wrench capable of operating on large fasteners in confined areas includes multiple body portions which can be connected in surrounding relationship to a nut. A bar or bars can be inserted into aligned slots in the wrench and the surrounded fastener so as to engage the wrench and the fastener for wrench operation.

6 Claims, 2 Drawing Sheets

NUT AND WRENCH SYSTEM

BACKGROUND OF THE INVENTION

1. Field of the Invention

This invention relates to wrenches and, more particularly, to a specialized wrench system that can be employed in tightly confined areas to apply torque to a large diameter threaded fastener.

2. Description of Related Art

Large diameter threaded fasteners are employed in a number of engineering applications. One such application is illustrated by FIG. 1, wherein is shown a crosshead portion of an integral engine compressor, a type of compressor that is manufactured by a division of the assignee of the present invention. Element 2 in that figure, a nut serving to attach compressor rod 4 to compressor crosshead 6, is, as is not atypical for a large compressor piston rod lock nut, a large diameter threaded fastener.

It is commonly desired in applications where such large diameter threaded fasteners are employed to apply substantial torque to those fasteners. Equally common is the desire to apply a certain proper preload to those fasteners. Both desires have been felt in regard to nut 2 shown in FIG. 1.

Various prior art devices; such as simple, large wrenches and more elaborate hydraulic wrenching systems; have been employed to apply substantial torque and proper preload to large threaded fasteners. In many applications, the prior art devices have worked well. In other applications, such as the application illustrated by FIG. 1, the various prior art wrenching devices and systems have been greatly hindered in, if not totally precluded, from operation because of limited room for movement around a fastener that it is desired to torque or preload and also because of limited access to such a fastener. The various prior art devices simply lack sufficient compactness and/or ability to be operated in tightly confined areas to constitute satisfactory tools for the aforementioned purposes under such conditions.

SUMMARY OF THE INVENTION

The present invention fulfills the need for a wrenching device and system capable of operating on threaded fasteners, regardless of how large those fasteners may be, and regardless whether those fasteners are situated in tightly confined areas and/or areas to which access is limited. Further, the present invention fulfills the need for such a wrenching device that is adequately controllable so as to allow application of a desired, proper preload on such a fastener. The present invention fulfills the aforementioned needs by comprising a wrench comprising a plurality of body portions which may be joined and separately connected in engaging relationship with a nut, and means for applying torque to said wrench when it is joined and separably connected in engaging relationship with said nut, said means comprising at least one reaction block having a threaded aperture, means for rotatably positioning said at least one reaction block with threaded aperture at a predetermined location relative to said wrench when joined and separably connected in engaging relationship with said nut, and at least one rotatable element including a portion having threads engaged with the threads of the threaded aperture in said reaction block and another portion abutting said joined and separably connected wrench at a point at which rotation of said rotatable element such that interaction of the rotatable element threads and the reaction block threads causes said rotatable element to drive towards said wrench and exert a turning force on said wrench which turns said wrench and, concurrently, said nut.

Accordingly, it is an object of the present invention to provide a means to apply large torque values to threaded fasteners.

Another object of the present invention is to provide a wrench system especially suitable for applying torque to very large threaded fasteners, such as compressor piston rod lock nuts.

Yet another object of the present invention is to provide a wrench system sufficiently compact so as to be capable of operating in tightly confined areas and/or areas to which access is limited.

Still yet another object of the present invention is to provide a wrench system which operations in an easily controllable manner so that a proper preload may be applied to threaded fasteners.

A further object of the present invention is to provide a wrench system exhibiting repeatability and reliability for torque applications involving threaded fasteners at joints, especially critical joints, such as the compressor rod attachment to the crosshead in a reciprocating engine compressor joint.

Other objects, advantages and novel features of the present invention will become apparent from the following detailed description of the invention when considered in conjunction with the accompanied drawings wherein:

DESCRIPTION OF THE PREFERRED EMBODIMENT

Figure 1:
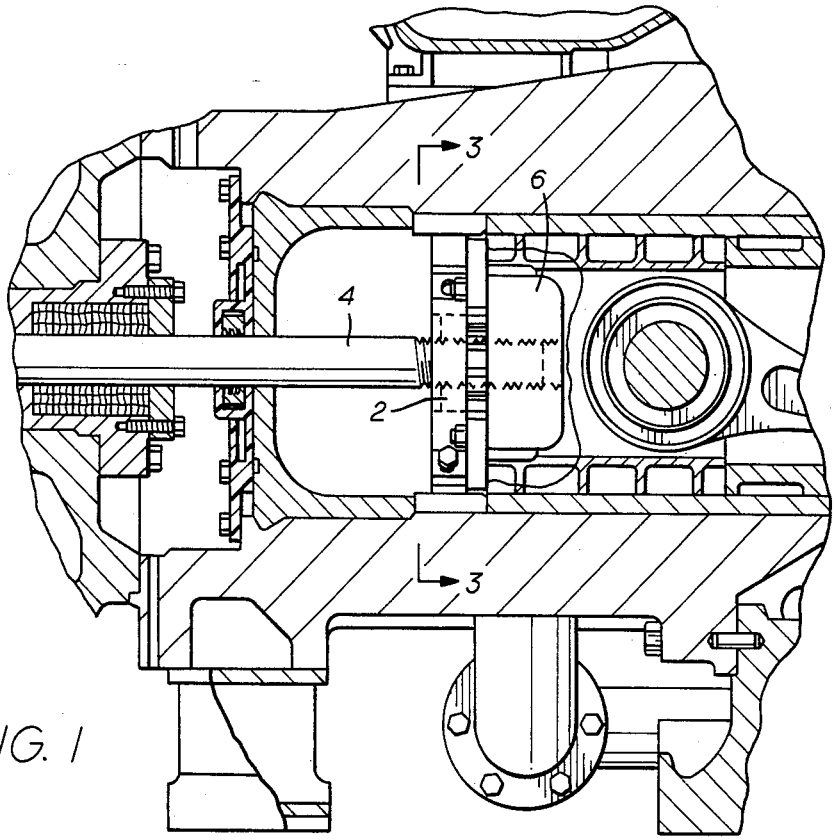
FIG. 1 is a fragmentary, partial, longitudinal section of a compressor having a large diameter threaded connection around which a wrench according to the present invention is installed.
Figure 2:
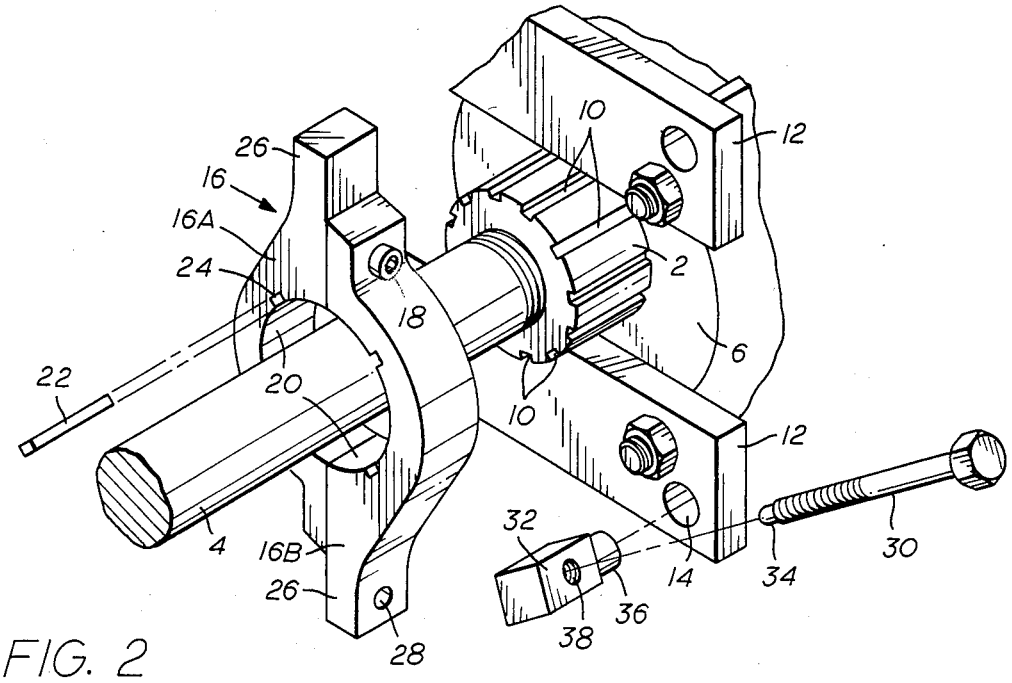
FIG. 2 is a fragmentary perspective view of the compressor of FIG. 1 and a partial, exploded perspective view of a nut and wrench system according to the present invention.
Figure 4:
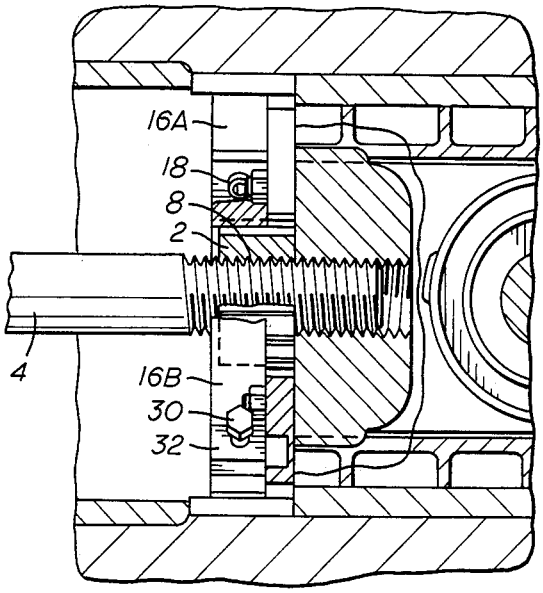
FIG. 4 is an enlarged, longitudinal section of a portion of the compressor shown in FIG. 1.

Referring now to FIG. 2, a nut employed to attach a compressor rod 4 to a compressor crosshead 6, that is, nut 2, which was discussed above in the references to FIG. 1, is best shown therein. Nut 2, as shown, consists of a circular cylinder with conventional screw threads 8 (those threads most clearly shown in FIG. 4) formed in the inside diameter, and a series of rectangular slots 10, parallel to the thread axis, evenly spaced around the outside diameter.

Nut 2, as can also be seen in FIG. 2, is employed in the vicinity of at least one structure 12 (two identical structures 12 shown) which may, as by having a hole 14 therein, be adapted to receive a portion of another element of the system of the present invention, said element, manner of attachment, and purpose of attachment described in greater detail below.

A wrench according to the present invention, generally designated by the reference numeral 16, consists of two identical body half portions 16A, 16B connected by at least one bolt or screw or other suitable connecting means 18 operating in conjunction with a perforated portion 19 of each body half portion. This feature allows the wrench 16 to be separated into two pieces 16A, 16B for easy installation and removal around a nut situated in a tightly confined area and/or area to which access is limited. Each half 16A, 16B has a semicircular cutout or band portion 20 which mates with the outside diameter of nut 2 and which has, or has adapted to have, one or more protrusions which mate with at least one slot 10 in nut 2 to unite them with regard to exposure to torquing forces in the same plane as wrench 16. In the embodiment shown in FIG. 2, a mating protrusion comprises bar 22 which is capable of forming a ridge projecting into a slot 10 in nut 2 when positioned in a slot 24 in the cutout portion 20 of a wrench half 16A. Of course, integral protrusions could be formed around the cutout portions 20 of wrench 16; the use of bar 22 is disclosed herein as preferred because with use of bar 22 presence of any protrusions can be avoided until mating of wrench 16 and nut 22 is desired, which feature enhances ease of positioning of wrench 16 around nut 2. Each wrench half 16A, 16B also has an arm 26 which extends radially away from nut 2 when wrench 16 is properly positioned around nut 2 and which arm has a hemispherical depression 28 near its distal end, relative to nut 2, the purpose of which depression 28 is described further below.

The system of the present invention also comprises at least one reaction block 32 and associated rotatable element or jackscrew 30. Reaction block 32 is adapted, as by including projecting portion 36, which portion 36 can mate with hole 14 in structure 12, so as to position reaction block 32 at a predetermined location relative to nut 2. Reaction block 32 also has a threaded hole 38 therethrough, so that a jackscrew 30 extending through hole 38 would be in the same plane as wrench 16 and approximately perpendicular to an arm 26 of wrench 16. For practical employment of the system of the present invention, threaded hole 38 (and jackscrew 30) should have thread size much smaller than that of the threads 8 of nut 2. Further, at least one jackscrew 30 should have an end 34 suitable for mating with depression 28 in one of the wrench halves 16B.

Figure 3:
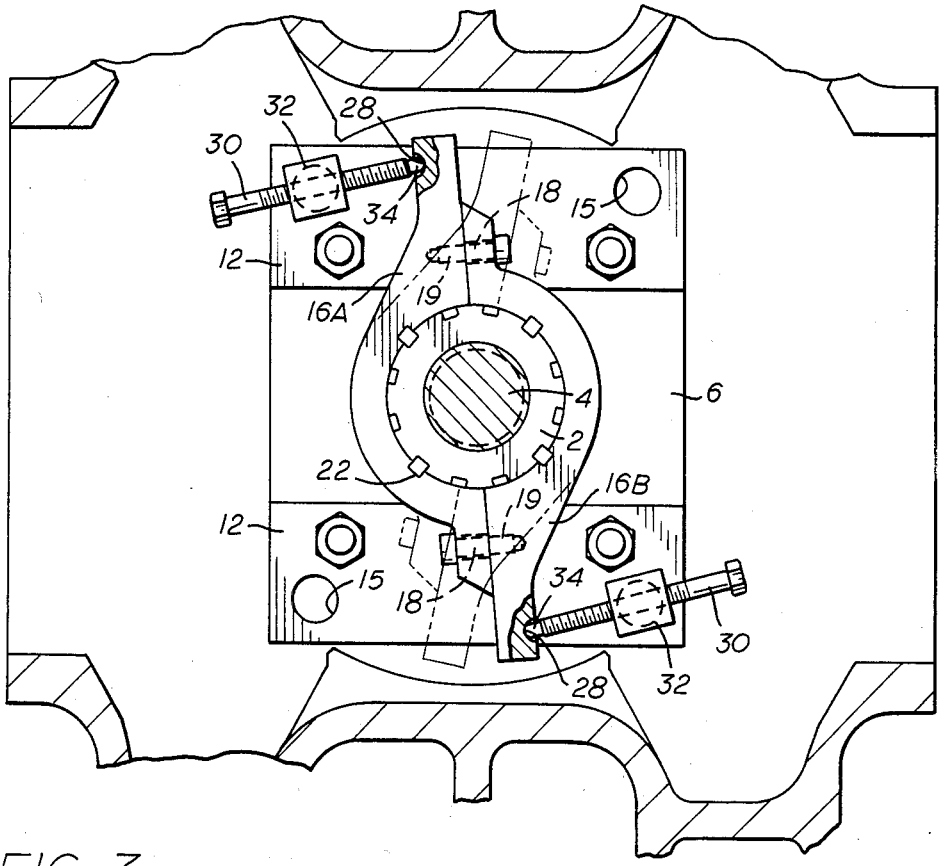
FIG. 3 is a fragmentary, partial section view taken on line 3—3 of FIG. 1.

Referring now to FIG. 3, a more complete view of the nut and wrench system of the present invention is shown therein. It can be seen that in this preferred embodiment that there are two reaction blocks 32 and associated jackscrews 30, one each for operation on respective arms 26 of wrench halves 16A, 16B. It can also be clearly seen that four bars 22 can be employed to engage wrench 16 and nut 2; it should be readily appreciated by those skilled in the art that countless bars 22 could be employed in the present invention but that only one such bar 22 need be employed; hence wrench 16 can readily be positioned around nut 2, limited only by the necessity of insuring that one slot 24 aligns with one slot 10. Further, direction of movement of wrench 16 (from position 1, drawn with solid lines, to position 2, drawn with broken lines) responsive to driving of both jackscrews 30 toward wrench 16 can be clearly seen in FIG. 3. Those skilled in the art will further recognize the special appropriateness of the above described method of mounting reaction block 32 to structure 12. As the projecting portions 36 of reaction blocks 32 can rotate in holes 14, the central axis of jackscrews 30 can, as may be necessary, change during turning of wrench 16. In addition, the rotatable feature of reaction block 32 mounting also allows for use of various sized wrenches (especially with regard to arm 26 length) without requiring a change in mounting position of reaction block 32.

All elements of the wrench system described above, that is, wrench halves 16A, 16B, wrench half connecting means 18, jackscrew 30, reaction block 32, and nut 2 can be constructed by conventional techniques of known rigid materials that will not deform under any forces which may develop when the system is installed and operated as described below to exert torque on nut 2.

In operation, the main threaded components, including nut 2, are assembled hand tight. Wrench body 16 is assembled and slipped axially onto nut 2. At least one slot 24 and slot 10 are aligned and a bar 22 is inserted so as to mate wrench 16 to nut 2. Reaction blocks 32 are mounted on structures 12. Jackscrews 30 are installed in reaction blocks 32 so as to extend through threaded apertures 38 and so as to have a hemispherical screw end 34 in contact with a depression 28 on wrench 16. Torque is applied with an ordinary hand wrench or similar tool to jackscrew 30 to tighten nut 2. Configured as in FIG. 3 and properly designed, the system of the present invention can develop mechanical advantages greater than 100 to 1 so that large torque values can be obtained at nut 2 with acceptable accuracy using ordinary hand torque wrenches on jackscrew 30 as should be readily apparent to those skilled in the art, for preferred operation of a system of the present invention hemispheric depression 28 may have an axis parallel to a tangent of the exterior side surface of the nut, that tangent being the tangent passing through the first point of intersection between the exterior side surface of the nut and a line perpendicular to the axis and extending toward the exterior side surface of the nut from a point centrally located within the depression 28.

Nut 2 can be loosened with the same tools by inverting wrench body 16 and providing additional holes (holes 15 in FIG. 3) for the jackscrew reaction blocks on the opposite side of the machinery structure, or by inverting the wrench body and rotating it approximately 90 degrees with respect to the structure.

Obviously many modifications and variations of this invention are possible in light of the above teachings. It is therefore to be understood that within the scope of the appended claims, the invention may be practiced otherwise than as specifically described.

We claim:

1. An apparatus for turning a nut having a circular exterior side surface with a plurality of slots formed thereon, said nut in the vicinity of a structure, said apparatus comprising:

a wrench comprising two identical body portions, each body portion having a perforated portion through which a portion of a threaded fastener may pass, a center portion defining a semicircular band with at least one protrusion, which band and at least one protrusion mate with the exterior side surface of said nut and the plurality of slots formed thereon respectively, and a arm portion extending radially away from an engaged nut and containing a hemispheric depression on the distal end thereof, said hemispheric depression having an axis parallel to a tangent of the exterior side surface of the nut, that tangent being the tangent passing through the first point of intersection between the exterior side surface of the nut and a line perpendicular to the axis and extending toward the exterior side surface of the nut from a point centrally located within the depression, and said arm portions further containing interiorly threaded voids on the proximal end thereof, two threaded fasteners which act to connect said two identical body portions when joined so as to mate with the nut, the two threaded fasteners so acting by each passing through a perforated portion of one body portion and threadedly engaging an interiorly threaded void of the other body portion;

two reaction blocks, each having a threaded hole therethrough and each rotatably positioned on said structure so that hole axes can coincide with one and the other axes of the hemispheric depressions, and two jackscrews extending through and engaged with the threads in the holes of one and the other of said reaction blocks, each jackscrew having a head end adapted to accept a driving tool and a leading driven end, which leading driven end mates with one or the other of said hemispheric depressions, whereby driving of the heads of said jackscrews applies torque to said wrench and, concurrently, said nut.

2. The apparatus of claim 1 wherein said at least one protrusion comprises a bar in a slot breaking up the semicircular band of said wrench, said bar of sufficient height to partially project out of the slot in the semicircular band in which positioned so as to effectively form a protrusion.

3. The apparatus of claim 2 wherein thread size of the threads within the reaction blocks is much smaller than that of the thread in the nut.

4. An apparatus for turning a nut having a circular exterior side surface with at least one slot thereon, said nut being in the vicinity of a structure, said apparatus comprising:

a wrench comprising two identical body portions which may be joined and separably connected in engaging relationship with said nut, each body portion of said wrench defining a semicircular band interrupted by at least one slot, any one of which can be aligned with a slot in the circular exterior said surface of a nut around which the wrench is positioned; and means for applying torque to said wrench when it is joined and separably connected engaging relationship with said nut, said means comprising:

two reaction blocks having a threaded aperture therethrough, means for attaching said two reaction blocks to said structures, and two jack screws including a portion having threads engaged with the threads of the threaded aperture said reaction block and another portion abutting said joined and separably connected wrench at a point at which rotation of said jack screws can, because of interaction of the jack screw threads in the reaction block threads, cause said jack screws to drive toward said wrench and exert a turning force on said wrench which turns said wrench, and concurrently, said nut.

5. The apparatus of claim 4 further comprising a bar which can be inserted into two aligned slots and when so inserted, extend at least partially into both aligned slots so as to rigidly position said wrench and said nut relative to each other with regard to exposure to torquing forces in the same plane as the wrench.

6. The apparatus of claim 4 wherein said means for attaching said two reaction blocks to said structure effects rotatable attachment.

* * * * *